US006865366B2

(12) United States Patent
Katayanagi et al.

(10) Patent No.: US 6,865,366 B2
(45) Date of Patent: Mar. 8, 2005

(54) FIXING APPARATUS EQUIPPED WITH SHEET FLATTENER

(75) Inventors: Hidetoshi Katayanagi, Tokyo (JP); Hajime Tanaka, Hachioji (JP); Toshiki Hayami, Hachioji (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 10/401,398

(22) Filed: Mar. 28, 2003

(65) Prior Publication Data

US 2003/0190180 A1 Oct. 9, 2003

(30) Foreign Application Priority Data

Apr. 4, 2002 (JP) ..... P2002-102314

(51) Int. Cl.[7] ..... G03G 15/00
(52) U.S. Cl. ..... 399/406; 399/328
(58) Field of Search ..... 399/406, 405, 399/300, 331, 397, 328

(56) References Cited

U.S. PATENT DOCUMENTS 5,187,527 A * 2/1993 Forlani et al. ..... 399/406
5,202,737 A * 4/1993 Hollar ..... 399/406
5,258,815 A * 11/1993 Nakagawa et al. ..... 399/406
5,287,157 A * 2/1994 Miyazato et al. ..... 399/406
5,396,318 A * 3/1995 Asada ..... 399/328
5,555,083 A * 9/1996 Kuo et al. ..... 399/406
5,802,440 A * 9/1998 Maeyama ..... 430/99
6,032,015 A * 2/2000 Umeda et al. ..... 399/306
6,137,986 A * 10/2000 Sugino et al. ..... 399/333
6,246,860 B1 * 6/2001 Ohmichi ..... 399/406
6,259,888 B1 * 7/2001 Kazama et al. ..... 399/406
6,304,741 B1 * 10/2001 Tange ..... 399/328

FOREIGN PATENT DOCUMENTS

JP 05-150679 6/1993
JP 2000-172103 A 6/2000

* cited by examiner

*Primary Examiner*—Anthony H. Nguyen
(74) *Attorney, Agent, or Firm*—Frishauf, Holtz, Goodman & Chick, P.C.

(57) ABSTRACT

A fixing apparatus includes a fixing roller, a fixing belt forming a nip between them, a heat source for heating at least one of the rollers, wherein a recording medium carrying an unfixed toner image passes through the nip to perform fixing operation, and a flattener having a conveyance roller and a pressure contact member which is in pressure contact with the conveyance roller, which is provided downstream in the conveying direction of the recording medium of the nip. A convex shape of the nip formed by the fixing roller and the fixing belt, and a convex shape of a nip of the flattener formed by the conveyance roller and the pressure contact member are arranged to have opposite directions to each other, when viewed from a direction perpendicular to the conveyance direction of the recording medium.

10 Claims, 3 Drawing Sheets

FIXING APPARATUS EQUIPPED WITH SHEET FLATTENER

BACKGROUND OF THE INVENTION

The present invention relates to the improvement of a fixing apparatus in an image forming apparatus for forming an image according to electrophotographic method.

A heat roller type fixing apparatus using a pair of rollers is a fixing apparatus to be commonly used. To meet the requirements for color images and diversified recording media, a fixing apparatus using a belt is proposed. The fixing apparatus using a belt has the following advantages. The belt driven along the roller makes it possible to increase the width of the nip gripping a recording medium, and to prolong toner heating time, thereby ensuring improved heating efficiency. Thus, fixing by use of a belt is effective when there is a thick toner layer forming an image as in the case of a color image or when the transparency of an image is increased by raising the level of toner fusing, as in the case of an overhead transparency film (OHP film).

Belt type fixing apparatus are disclosed in the Official Gazette of Japanese Application Patent Laid-Open Publication Nos. Hei 05-150679 and 2000-172103, for example.

As described in the aforementioned Official Gazettes of the Japanese Patent, the belt type fixing apparatus is basically characterized in that a fixing roller forming a nip is brought into pressure contact with a belt which is supported by supporting rollers. The heat source for heating a toner image is provided inside the support roller or the fixing roller in the fixing unit.

This configuration inevitably causes a convex nip to be formed on one side by the fixing roller. A recording medium passing through the convex nip on one side is often deformed and curled. Since recording medium is heated at the nip, it is deprived of water and the shape of the nip tends to make the recording medium to curl. This raises problems in the conveyance of the recording medium after fixing process, with the result that recording media are ejected irregularly. Further, a sufficient nip width cannot be ensured to reduce the curl, so that a sufficient fixing performance cannot be obtained, according to the prior art.

SUMMARY OF THE INVENTION

The object of the prevent invention is to solve the aforementioned problems in a belt-based fixing process and to provide a fixing apparatus capable of fixing of color images and overhead transparency films (OHP sheets), and ensuring a sufficient nip width required for fixing process, without causing a curl on a recording medium.

The object of the present invention can be achieved by any one of the following Structures (1) through (10).

(1). A fixing apparatus comprising: a fixing roller, a fixing belt forming a nip between the fixing roller and the fixing belt, and a heat source for heating at least one of the aforementioned roller and belt; wherein a recording medium carrying an unfixed toner image is passed through the aforementioned nip to perform fixing operation. This fixing apparatus is further characterized in that a flattener comprising a conveyance roller and a pressure contact member which is in pressure contact with the conveyance roller, is provided downstream in the conveying direction of the recording medium of the aforementioned nip. It is still further characterized in that a convex shape of the nip formed by the fixing roller and the fixing belt, and a convex shape of a nip of the flattener formed by the conveyance roller and the pressure contact member are arranged to have opposite directions to each other, when viewed from a direction perpendicular to the direction in which the recording medium is conveyed.

(2). A fixing apparatus according to the above structure (1) further characterized in that the fixing belt is supported by at least two support rollers and the aforementioned heat source is provided in at least one of these support rollers.

(3). A fixing apparatus according to the above structure (1) or (2) further characterized in that the heat source is arranged inside the fixing roller.

(4). A fixing apparatus according to any one of the above structures (1) through (3) further characterized in that the pressure contact member has a roller shape, and roller hardness of the conveyance roller and the pressure contact member is different from each other.

(5). A fixing apparatus according to any one of the above structures (1) through (3) further characterized in that the pressure contact member is a endless belt.

(6). A fixing apparatus comprising: two endless belts, a backup member provided in each of the aforementioned endless belts, and a heat source for heating at least one of these endless belts; wherein the aforementioned two endless belts are brought in pressure contact with each other by these backup members to form a nip between the two endless belts, and a recording medium is passed through this nip, thereby performing fixing. This fixing apparatus is further characterized in that the aforementioned backup member is formed in such a way that the upstream side of the aforementioned nip in the traveling direction of a recording medium is approximately flat, and the downstream side of the nip in the traveling direction of the recording medium is formed to be convex toward the aforementioned endless belt that is in contact with the toner image carrying surface of the recording medium.

(7). A fixing apparatus according to the structure (6) characterized in that each of the backup members is made of an elastic material, and the backup members are composed of a backup member A (304 of FIG. 5) provided inside the endless belt that is in contact with the toner image carrying surface of the recording medium, a backup member B1 (309 of FIG. 5) provided inside the endless belt that is not in contact with the toner image carrying surface and provided on the upstream side of the nip in the traveling direction of the recording medium, and a backup member B2 (310 of FIG. 5) provided inside the endless belt that is not in contact with the toner image carrying surface and provided on the downstream side of the nip in the traveling direction of the recording medium, and further hardness of the backup members A and B1 are equal to each other, and hardness of the backup member B2 is greater that that of the backup member B1.

(8). A fixing apparatus according to the structure (6) or (7) characterized by having a roller for supporting and conveying each of the aforementioned endless belts.

(9). A fixing apparatus according to the structure (8) characterized in that the heat source is arranged in at least one of the aforementioned rollers.

(10). A fixing apparatus according to any one of the structures (6) through (9) characterized in that the nip is formed in such a way that a width of a portion formed in an approximately flat shape of the nip in the traveling direction of the recoding medium is greater than that of a portion formed in the convex shape.

DETAILED DESCRIPTION OF THE PREFERRED EMBODIMENT (1)<Image Forming Apparatus>

Figure 1:
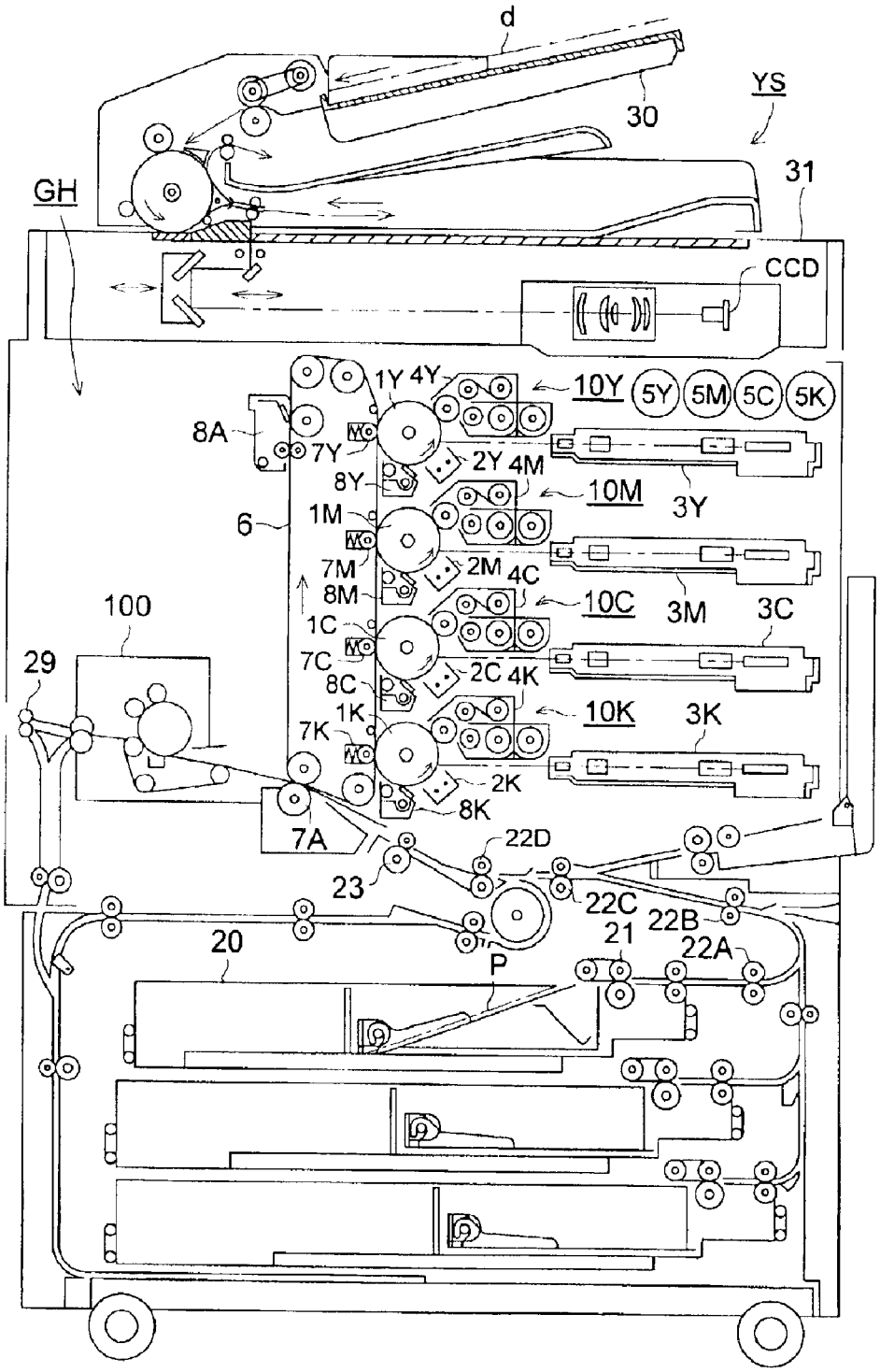
FIG. 1 is a drawing representing an image forming apparatus using the fixing apparatus relating to Embodiment of the present invention.

FIG. 1 is a drawing representing a color copier as an example of an image forming apparatus using a fixing apparatus relating to Embodiment of the present invention.

The main body GH of the image forming apparatus is what is called a tandem type color image forming apparatus, and has plural sets of image forming units 10Y, 10M, 10C and 10K, an belt shaped intermediate transfer unit 6, a paper supply means and a fixing apparatus 100.

The image forming unit 10Y for forming a yellow image includes electrostatic charging device 2Y arranged around a photoconductor 1Y as an image carrier, exposure device 3Y, development device 4Y, and cleaning device 8Y. The image forming unit 10M for forming a magenta image includes a photoconductor 1M as an image carrier, electrostatic charging device 2M, exposure device 3M, development device 4M, and cleaning device 8M. The image forming unit 10C for forming a cyan image includes a photoconductor 1C as an image carrier, electrostatic charging device 2C, exposure device 3C, development device 4C, and cleaning device 8C. The image forming unit 10K for forming a black image includes a photoconductor 1K as an image carrier, electrostatic charging device 2K, exposure device 3K, development device 4K, and cleaning device 8K.

The intermediate transfer body 6 is an endless belt trained about a plurality of rollers, and is rotatably supported by them.

The images of each color formed by image forming units 10Y, 10M, 10C and 10K are sequentially transferred onto the rotating intermediate transfer body 6 by transfer device 7Y, 7M, 7C and 7K (in a primary transfer step), whereby a composite color image is formed. The recording medium P stored in the sheet feeding cassette 20 is fed by the sheet feeding device 21, and is fed to a transfer device 7A paper supply rollers 22A, 22B and 22C, and a registration roller 23. Then color image is transferred onto the recording medium P (in the secondary transfer step). The recording medium with color image transferred thereon is subjected to fixing processing by means of a fixing apparatus 100. It is sandwiched by ejection rollers 29 and is placed onto an ejection tray 29.

After the color image is transferred to the recording medium P by the transfer device 7A, residual toner is removed by cleaning device 8A from the intermediate transfer body 6 where recording medium P has been separated.

Symbols 5Y, 5M, 5C and 5K denote the toner supply device that supply replenishment toner to development device 4Y, 4M, 4C and 4K.

An image reader YS composed of an automatic document feeder 30 and document image scanning and exposing unit 31 is installed on the top of the main body GH of the image forming apparatus. Document d placed on the document tray of the automatic document feeder 30 is fed by the feeder, and the image on the single side or double sides of the document is scanned and exposed by the optical system of the document image scanning and exposing unit 31 and is read by the line image sensor CCD.

Having been subjected to photoelectric conversion by a line image sensor CCD, analog signals are subjected to analog processing, analog-to-digital conversion, shading compensation and image compression at an image processor. Then, they are sent to image writers (exposure device) 3Y, 3M, 3C and 3K.

The automatic document feeder 30 is equipped with an automatic double sided document feeder. This automatic document feeder 30 reads at a stretch on a continuous basis multiple documents d fed from the document tray, and stores such information into a storage unit (by means of an electronic RDH function). These capabilities are effectively used when multiple documents are copied by a copying function or when multiple documents are sent by a facsimile function.

Negatively charged organic photoconductors are preferred as photoconductors 1Y, 1M, 1C and 1K. The organic photoconductor can be defined as an electrophotographic photoconductor composed of an organic photoconductor having at least one of the electrical charge generating function and electrical charge transport function essential to the configuration of an electrophotographic photoconductor. It includes all the known organic photoconductors such as a photoconductor composed of known electrical charge generating substances or electrical charge transport substances, and a photoconductor containing a high polymer complex provided with the electrical charge generating function and electrical charge transport function.

Negatively charged polymer toner is preferred as toner used in the development devices 4Y, 4M, 4C and 4K. Polymer toner can be defined as the toner that is obtained by generation of binder resin for toner and the particle shape of toner is determined by polymerization of the material polymer or pre-polymer of the binder resin and subsequent chemical treatment. To put it more specifically, it can be defined as the toner that is obtained by polymerization reaction such as suspension polymerization and emulsion polymerization, and fusion among particles that takes place subsequently as required. Granulated polymerization toner is formed by polymerization of the material monomer or pre-polymer having been dispersed uniformly in aqueous system, and hence it is characterized by uniform particle distribution and shape. Styrene-acrylic toner containing the wax of low melting point is preferred as toner used in this Embodiment.

Low-melting wax is selected from among paraffin wax, micro crystalline wax, natural gas based Fischer-Tropsch wax, coal based Fischer-Tropsch wax, wax obtained from molecule distillation of these types of wax, polypropylene of low molecular weight and polyethylene of low molecular weight synthesized by metallocene catalyst.

(2)<Embodiment 1>

Figure 2:
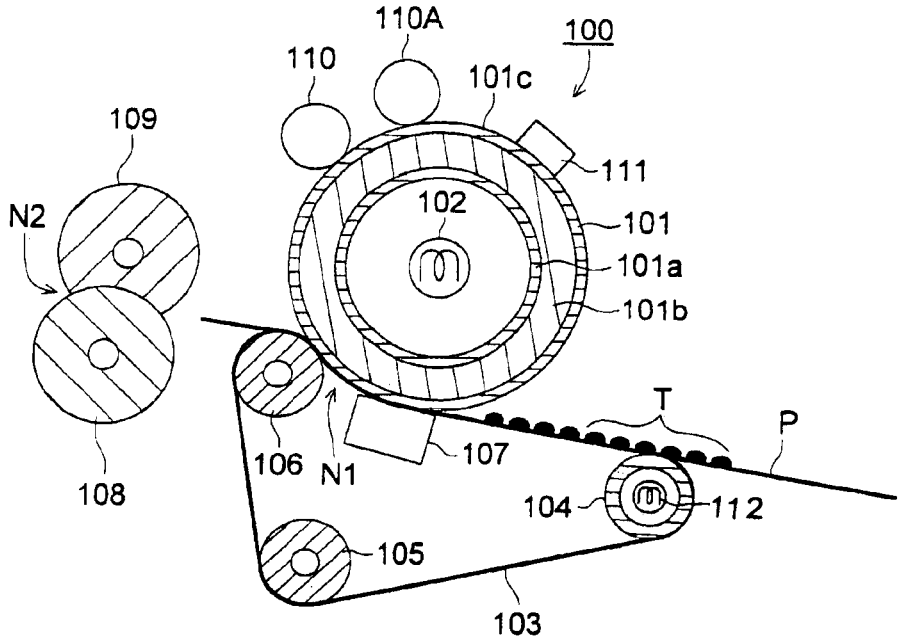
FIG. 2 is a drawing representing the fixing apparatus relating to Embodiment 1 of the present invention.

FIG. 2 shows the fixing apparatus 100 relating to Embodiment 1 according to the present invention.

Heat roller 101 as a fixing roller is composed of a substrate 101*a* consisting of aluminum cylinder, a heat proof elastic layer consisting of silicone rubber and a surface layer 101*c* coated or lined with fluorine resin as a mold releasing material. PFA (copolymer between tetrafluoroethylene and perfluoro (alkylvinyl ether)) is preferred as material of the surface layer 101*c*. A halogen lamp 102 as a heat source is arranged in the heat roller 101.

Numeral 103 denotes the endless belt as a fixing belt that is in pressure contact with the heat roller 101. The belt of this type used here is formed by coating or lining the fluorine resin layer made of PFA on the substrate having the heat proof resin film such as polyimide film or metallic film made of carbon steel, stainless steel, nickel or the like. It is also possible to use a belt formed by a silicone rubber layer provided on the heat proof resin film or metal substrate, or to use an endless belt 103 formed of a silicone rubber layer provided on this substrate or this silicone rubber layer coated or lined with a fluorine resin layer. The endless belt 103 is trained about three support rollers 104, 105 and 106. A heat source 112 may be installed inside the support roller 104. Numeral 107 denotes a backup member composed of a heat proof elastic body such as silicone rubber. The endless belt 103 is pressed against the heat roller 101 to stabilize the feed of the recording medium P on the nip N1. The nip N1 can be stably formed by the pressure of the backup member 107 and support roller 106, and the nip N1 in the traveling direction of the recording medium can be formed to have a desired width. Numeral 108 denotes a hard roller as a conveyance roller composed of resin or metal, and 109 shows a soft roller as a conveyance roller made of an elastic layer such as rubber arranged on a core. The hard roller 108 and soft roller 109 constitute a flattener for straightening the curl of the recording medium. Since the temperature of the recording medium is often considerably high where the flattener is located, it is preferred that the elastic body used for this purpose be made of heat proof elastic material such as silicone rubber. When the recording medium P exceeds the glass transition point of toner especially in the flattener, it is preferred that the surface layer consisting of fluorine resin layer be provided on the hard roller 108 and soft roller 109. The hard roller 108 may contain such an elastic layer as rubber, as described above, in addition to such a rigid body as metal or resin. In this case, the elastic layer of the hard roller 108 has a greater degree of hardness than soft roller 109, or is made thinner than the elastic layer of the soft roller 109. Numeral 110 denotes a cleaning roller, 110 A an oil coated roller, and ill a temperature sensor for detecting the surface temperature of the heating roller 101. This sensor is used under contact or non-contact conditions.

In the aforementioned configuration, the surface layer 101*c* of the heat roller 101 is composed of PFA, and does not require oiling when toner contains not less than 10 wt % wax as an offset preventive agent.

The nip N1 having the heat roller 101 and endless belt 103 is controlled by the heat roller 101, as illustrated, and is arranged to be convex downward. The nip N2 of the flattener composed of the hard roller 108 and soft roller 109 is controlled by the hard roller 108, and is configured to be convex upward.

The recording medium P carrying unfixed toner image T on the upper surface is heated by the heat roller 101 at the nip N1 of the fixing unit, whereby toner image is fixed in position. At the nip N1 of the fixing unit, the recording medium P is subjected to the force of bending to be convex downward in the drawing. At the nip N2 of the flattener, it is controlled by the hard roller 108 and soft roller 109 and is subjected to the force of bending in the direction opposite to that at the nip N1. As a result, the recording medium P having passed through the hard roller 108 and soft roller 109 is ejected with being little curled.

(3)<Embodiment 2>

Figure 3:
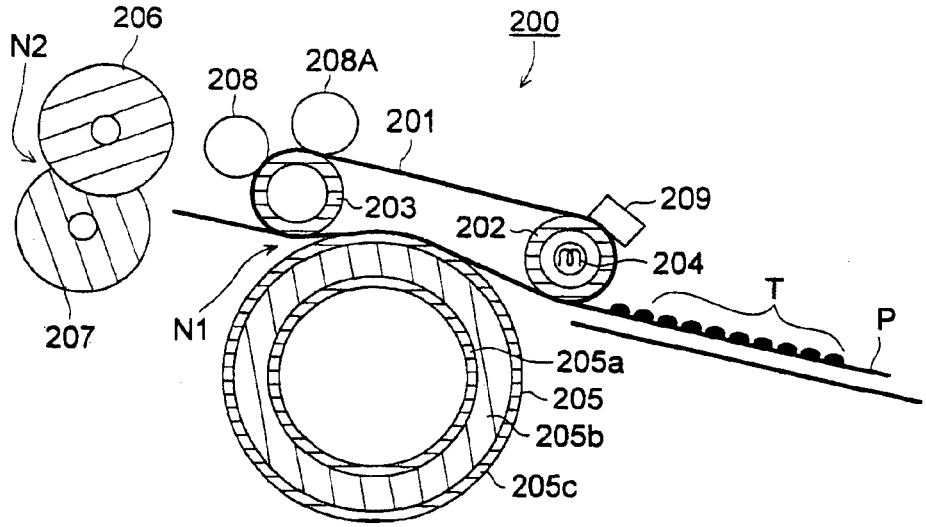
FIG. 3 is a drawing representing the fixing apparatus relating to Embodiment 2 of the present invention.

FIG. 3 is a drawing representing the fixing apparatus 200 as Embodiment 2 of the present invention. It is used in place of the fixing apparatus 100 in FIG. 1. In FIG. 3, the endless heating belt 201 used here is formed by coating or laminating a mold releasing layer made of fluorine resin or the like on the substrate consisting of such a heat proof resin film as polyimide film or a metallic film made of carbon steel, stainless steel and nickel. It is also possible to use a belt made by providing such an elastic layer as a silicone rubber layer on the substrate of heat proof resin film or metal, and by laminating a mold releasing layer consisting of fluorine resin or the like on this elastic layer. Use of PFA is preferred to form a mold releasing layer of the endless heating belt 201. The endless heating belt 201 is trained about the support rollers 202 and 203 consisting of metal. A halogen lamp 204 as a heat source is arranged in the support roller 202. The endless heating belt 201 is heated by the halogen lamp 204 through the support roller 202. The pressure roller 205 as a fixing roller comprises a core 205*a*, a heat proof elastic layer 205*b* such as silicone rubber and a mold releasing layer 205*c* consisting of fluorine resin such as PFA. The pressure roller 205 is brought in pressure contact with the endless heating belt 201. It should be noted that a heat source may be provided inside the pressure roller 205.

Numeral 206 denotes a hard roller as a conveyance roller consisting of resin or metal, and 207 a soft roller as a conveyance roller consisting of a core provided with an elastic layer such as rubber. The hard roller 206 and soft roller 207 constitute a flattener for straightening the curl of the recording medium P. Since the temperature of the recording medium is often considerably high where the flattener is located, it is preferred that the elastic body used for this purpose be made of heat proof elastic material such as silicone rubber. When the recording medium P exceeds the glass transition point of toner especially in the flattener, it is preferred that the surface layer consisting of fluorine resin layer be provided on the hard roller 206 and soft roller 207.

The hard roller 206 may contain such an elastic layer as rubber, as described above, in addition to such a rigid body as metal or resin. In this case, the elastic layer of the hard roller 206 has a greater degree of hardness than soft roller 207, or is made thinner than the elastic layer of the soft roller 207. Numeral 208 denotes a cleaning roller, 208*a* an oil coated roller, and 209 a temperature sensor for detecting the surface temperature of the heating roller 201. This sensor is used under contact or non-contact conditions.

The nip N1 of the fixing unit formed by the endless heating belt 201 and the pressure roller 205 is controlled by the pressure roller 205, as illustrated, and is arranged to be convex upward. The nip N2 of the flattener formed by the hard roller 206 and soft roller 207 is controlled by the hard roller 206, and is configured to be convex downward.

The recording medium P carrying unfixed toner image T on the upper surface is heated by the endless heating belt 201 at the nip N1 of the fixing unit, whereby toner image is fixed in position. At the nip N1, the recording medium P is subjected to the force of bending to be convex upward in the drawing. At the nip N2 of the flattener, the recording medium P is controlled by the hard roller 206 and soft roller 207 and is subjected to the force of bending in the direction opposite to that at the nip N1 of the fixing unit. As a result, the recording medium P having passed through the hard roller 206 and soft roller 207 is ejected with being little curled.

Figure 4:
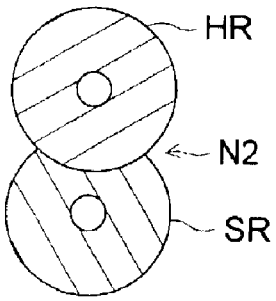
FIGS. 4(*a*) and 4(*b*) are drawings representing an example of a flattener.
Figure 4:
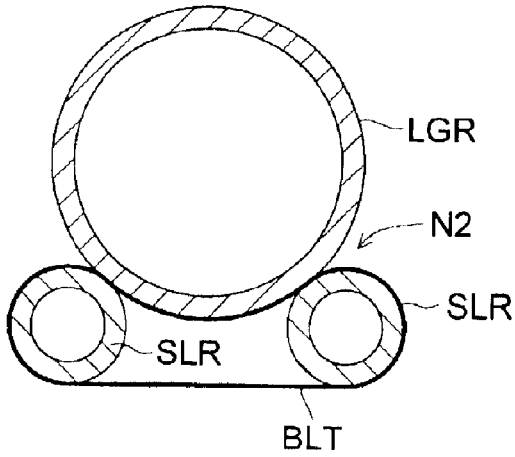

FIGS. 4(*a*) and 4(*b*) are drawings representing examples of flatteners. The flattener of FIG. 4(*a*) comprises a hard roller HR and soft roller SR, as shown in FIGS. 2 and 3. As described above, the hard roller HR is composed of a rigid body made of metal, resin or the like, and the soft roller SR is made of a roller containing an elastic layer. Alternatively, both rollers can be made of rollers containing elastic layers, where the elastic layer of the hardware HR is made harder than that of the soft roll SR. Curl is corrected by the flattener nip N2 between the hard roller HR and soft roller SR. FIG. 4(*b*) shows an example of an another flattener consisting of a large-diameter roller LGR, and the combination of small diameter rollers SLR and belt BLT as a flattener belt. Curl is corrected by the nip N2 of the flattener between the large diameter roller LGR and belt BLT.

(4)<Embodiment 3>

Figure 5:
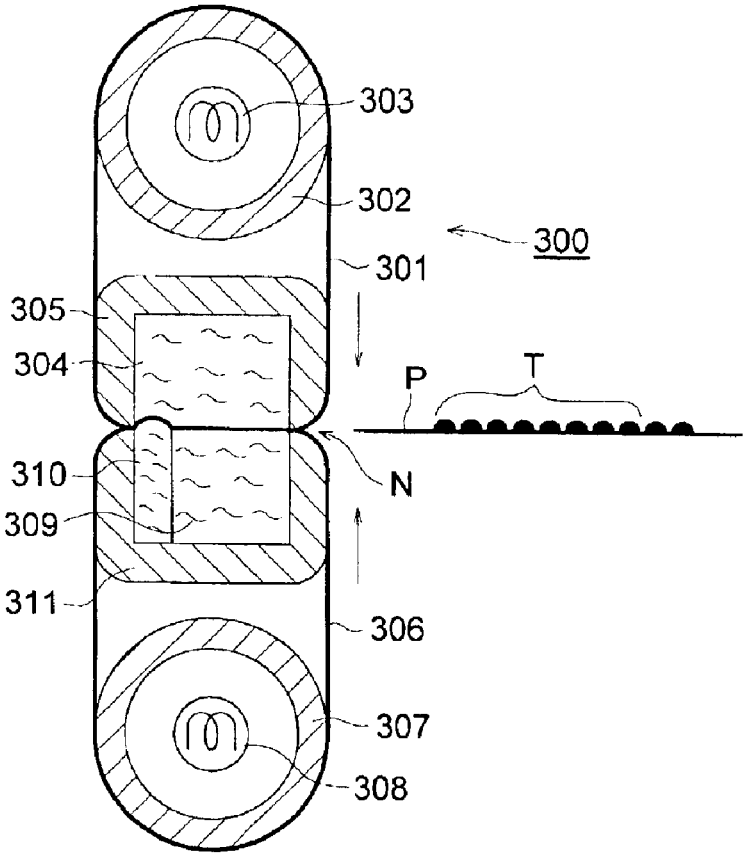
FIG. 5 is a drawing representing the fixing apparatus relating to Embodiment 3 of the present invention.

FIG. 5 is a drawing representing the fixing apparatus relating to Embodiment 3 of the present invention. The fixing apparatus 300 in FIG. 5 is used in place of the fixing apparatus 100 in FIG. 1.

Numerals 301 and 306 denote endless heating belts, and are formed by coating or laminating a fluorine resin layer on such a heat proof resin film as polyimide film or a metallic film made of carbon steel, stainless steel and nickel. It is also possible to provide a silicone rubber layer on the substrate of heat proof resin film or metal, and to provide a surface layer consisting of fluorine resin on this silicone rubber layer. Use of PFA is preferred as fluorine resin. Numerals 302 and 307 denote support rollers made of metal, and halogen lamp 303 and 308 as heat sources are arranged inside the support rollers 302 and 307. In the illustrated example, the endless heating belts 301 and 306 are heated by the halogen lamp 303 and 308, respectively, so that the recording medium P is heated. It is also possible to install a halogen lamp 303 only inside the support roller that supports the endless heating belt 301 brought in contact with the toner carrying surface of the recording material P.

Numerals 304 and 309 denote backup members made of a heat proof elastic body such as silicone rubber. They each support the endless heating belts 301 and 306, and form a nip N. Numeral 305 indicates a support member having a U-shaped cross section for supporting the backup member 304, and 301 denotes a support member having a U-shaped cross section for supporting the backup member 309. It is preferred that the support members 305 and 311 be heat-proof and have an excellent slippage with respect to the endless heating belts 301 and 306, respectively. Each of the support members 305 and 311 is constituted by a resin material containing, for example, PAI (polyamideimide), PI (polyimide) or PPS (polyphenylene sulfide) as a main component.

Numeral 310 denotes a backup member that cooperates with the backup member 309 to form a nip N. The backup members 304 and 309 have almost the same degree of hardness, and the backup member 310 has a greater degree of hardness than the backup member 309. For example, when the hardness of the rubber of backup members 304 and 309 is JIS A1 through 30 degrees and the backup member 310 has a greater degree of hardness that this value, then a curl of the recording medium P after passing through the nip N can be suppressed. As illustrated, this configuration allows the nip N to be straight, i.e. plane on the upstream side in the traveling direction of the recording medium P. On the paper ejection side, the nip N is bent to be convex upward, i.e. is curved to be convex toward the endless heat belt 301 that is in contact with the toner image carrying surface of the recording medium P. Incidentally, in FIG. 5, the thickness in the horizontal direction of the backup member 304 is made greater than the depth of the hollow for the u-shaped support member 305. Similarly, the thickness in horizontal direction of the backup members 309 and 310 are made greater than the depth of the hollow of the u-shaped support member 311. This configuration allows pressure necessary for fixing to be given to the recording medium at the nip N.

The support roller 302 is connected to a drive source, and the endless heating belts 301 and 306 are moved in circulation by the drive force of the support roller 302 as illustrated by an arrow. The recording medium P having entered the nip N is fed, and the fixing operation is carried out at the nip N. The drive source may be connected to the support roller 307, or respective drive sources may be connected to the support rollers 302 and 307. The optimum fixing performance is ensured since the nip N can be set to a desired length in conformity to the profiles of the backup members 304 and 309. It is preferred that the straight portion in nip N be greater than the portion to be curved convex upward in terms of the width in the traveling direction of the recording medium.

To minimize the amount of curl on the recording material after fixing, it is preferred that nip N be flat over the entire surface, i.e. its cross section is preferred to be straight. However, it becomes difficult to separate the toner carrying surface of the recording medium if the nip is formed straight. In the present Embodiment, the backup member 310 harder than other members is provided so that the nip on the paper ejection side is made to be convex toward the side of the endless heat belt 301 that is in contact with the toner carrying surface of the recording medium P, and the width of the convex portion in the nip N is lowered than that of the straight portion. This ensures effective suppression of the aforementioned curl, and improves separability between the recording medium P carrying toner and the endless heat belt 301.

To improve slippage of the endless heating belts 301 and 306 with respect to U-shaped support members 305 and 311 and backup members 304, 309 and 310, a fluorine resin sheet having a thickness of tens of micrometers may be inserted in-between. Silicone rubber is preferred as the material for backup members 304, 309 and 310, as described above. It is also possible to use a foamed silicone rubber in order to minimize the heat absorbed by these backup members.

In the aforementioned example, a halogen lamp is used as a heat source. It is also possible to use a desired known heating element such as a resistance heating element or induction heating element. The heat source can be placed inside or outside the fixing belt, in addition to inside the fixing roller.

In a fixing apparatus having a combination of a roller and belt, fixing operation is carried out in the process of the belt traveling along the peripheral surface of the roller, so a bending force is applied to the recording medium passing through the nip between the belt and roller so that the recoding medium is curled. However, such curl is corrected by any one of the aforementioned apparatus 1 through 5 characterized by the structures described above. This feature avoids possible feeding failure in handling the post-treated or ejected recording medium or alignment failure among the sheets of paper to be ejected.

A fixing nip is formed by the backup members according to any one of the apparatus 6 through 10 having the aforementioned structures. This makes it possible to form the nip in a desired shape, thereby ensuring the required fixing performance and minimizing the curl of the recording medium. Further, when the paper ejection side of the nip is curved to be convex toward the toner image carrying surface of the recording medium P, it is possible to improve the separability of the recording medium on the toner image carrying surface, and to minimize the curl of the recording medium in an effective manner.

What is claimed is:

1. A fixing apparatus comprising:

(a) a fixing roller;

(b) a fixing belt which is brought into pressure contact with the fixing roller so as to form a nip;

(c) a heat source for heating at least one of the fixing roller and the fixing belt, wherein a recording medium carrying an unfixed toner image passes through the nip so as to fix the toner image; and (d) a flattener provided downstream of the nip in a conveying direction of the recording medium for correcting a curl of the recording medium which has passed through the nip, wherein the flattener comprises a conveyance roller and a pressure contact member that is in pressure contact with the conveyance roller, wherein a surface layer of the conveyance roller and a surface layer of the pressure contact member are made of fluorine resin, and wherein a temperature of a second nip formed between the conveyance roller and the pressure contact member exceeds a glass transition point of the toner;

wherein the nip formed by the fixing roller and the fixing belt and the second nip formed by the conveyance roller and the pressure contact member both have a convex shape and are arranged to be convex toward opposite directions with respect to each other, when viewed from a direction perpendicular to the conveying direction of the recording medium.

2. The fixing apparatus of claim 1, wherein the fixing belt is supported by at least two support rollers and the heat source is provided inside at least one of the support rollers.

3. The fixing apparatus of claim 1, wherein the heat source is provided inside the fixing roller.

4. The fixing apparatus of claim 1, wherein the pressure contact member has a roller shape, and roller hardness of the conveyance roller and the pressure contact member are different from each other.

5. The fixing apparatus of claim 1, wherein the pressure contact member comprises an endless belt.

6. A fixing apparatus comprising:

(a) two endless belts;

(b) a backup member provided in each of the two endless belts for supporting each of the two endless belts; and (c) a heat source for heating at least one of the two endless belts, wherein each of the two endless belts is brought into pressure contact with each other by each of the backup members to form a nip between the two endless belts, and-a recording medium passes through the nip to perform fixing operation, wherein the backup member is formed in such a way that an upstream side of the nip in a traveling direction of the recording medium is approximately flat, and a downstream side of the nip in the traveling direction of the recording medium is formed to be convex toward the endless belt that is in contact with a toner image carrying surface of the recording medium.

7. The fixing apparatus of claim 6, wherein each of the backup members is made of an elastic material, the backup members comprising:

a first backup member provided inside the endless belt that is in contact with the toner image carrying surface;

a second backup member provided inside the endless belt that is not in contact with the toner image carrying surface and provided on the upstream side of the nip in the traveling direction of the recording medium; and a third backup member provided inside the endless belt that is not in contact with the toner image carrying surface and provided on the downstream side of the nip in the traveling direction, wherein hardness of the first and second backup members are equal to each other, and hardness of the third backup member is greater that that of the second backup member.

8. The fixing apparatus of claim 6, further comprising a roller for supporting and conveying each of the endless belts.

9. The fixing apparatus of claim 8, wherein the heat source is provided in at least one of the rollers.

10. The fixing apparatus of claim 6, wherein the nip is formed in such a way that a width of a portion formed approximately flat of the nip in the traveling direction of the recoding medium is greater than that of a portion formed to be convex.

* * * * *